US008302957B2

(12) United States Patent
Murray et al.

(10) Patent No.: US 8,302,957 B2
(45) Date of Patent: Nov. 6, 2012

(54) MOTOR INSIDE PICK-UP ROLLER

(75) Inventors: Richard A. Murray, San Diego, CA (US); Juan Manuel Jimenez, Escondido, CA (US); Wayne Edward Stiehler, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 367 days.

(21) Appl. No.: 12/392,352

(22) Filed: Feb. 25, 2009

(65) Prior Publication Data

US 2010/0213664 A1 Aug. 26, 2010

(51) Int. Cl.
*B65H 3/06* (2006.01)

(52) U.S. Cl. ..... 271/117; 271/118; 271/109

(58) Field of Classification Search ..... 271/117, 271/118, 109; 198/788
See application file for complete search history.

(56) References Cited

U.S. PATENT DOCUMENTS

| | | | | |
|---|---|---|---|---|
| 4,126,875 | A | 11/1978 | Wareham | 354/86 |
| 5,145,169 | A * | 9/1992 | Kato | 271/272 |
| 5,462,156 | A * | 10/1995 | Kobayashi et al. | 198/788 |
| 5,678,814 | A * | 10/1997 | Yokoyama et al. | 271/9.05 |
| 5,831,644 | A | 11/1998 | Kato | 347/22 |
| 5,971,520 | A | 10/1999 | Nakahara | 347/30 |
| 6,244,427 | B1 * | 6/2001 | Syverson | 198/788 |
| 6,257,569 | B1 * | 7/2001 | Rhodes et al. | 271/117 |
| 6,710,505 | B1 * | 3/2004 | Barani et al. | 310/261.1 |
| 6,722,493 | B2 * | 4/2004 | Matsuoka et al. | 198/788 |
| 6,766,900 | B2 * | 7/2004 | Kanaris | 198/835 |
| 6,846,060 | B2 | 1/2005 | Waller et al. | 347/22 |
| 6,877,735 | B2 * | 4/2005 | Fujiwara | 271/117 |
| 7,004,460 | B2 * | 2/2006 | Ruhe et al. | 271/113 |
| 7,086,524 | B2 * | 8/2006 | Hayashi et al. | 198/788 |
| 7,225,697 | B2 | 6/2007 | Schalk et al. | 74/405 |
| 7,350,902 | B2 | 4/2008 | Dietl et al. | 347/43 |
| 7,413,184 | B2 * | 8/2008 | Lai | 271/117 |
| 7,594,651 | B2 * | 9/2009 | Hall et al. | 271/117 |
| 7,673,871 | B2 * | 3/2010 | Bokelman et al. | 271/117 |
| 2008/0179816 | A1 * | 7/2008 | Feijen et al. | 271/117 |

OTHER PUBLICATIONS

U.S. Appl. No. 11/969,265, filed Jan. 4, 2008, Balcan, et al.
U.S. Appl. No. 11/969,277, filed Jan. 4, 2008, Balcan.
U.S. Appl. No. 12/178,849, filed Jul. 24, 2008, Zhang.

* cited by examiner

*Primary Examiner* — Luis A Gonzalez
(74) *Attorney, Agent, or Firm* — Eugene I Shkurko; Stephen H. Shaw

(57) ABSTRACT

A pick-up assembly moves a sheet of recording medium from a stack of recording media. The pick-up assembly includes a pick arm having a first end and a second end. Notably, a pivotal mounting is located proximate the first end of the pick arm; and a pick-up roller is mounted proximate the second end of the pick arm. Lastly, a motor and a transmission are located inside the pick-up roller.

45 Claims, 14 Drawing Sheets

MOTOR INSIDE PICK-UP ROLLER

FIELD OF THE INVENTION

This invention relates generally to the field of media handling for imaging systems such as printers, and in particular to the source of power for a pick-up roller that advances a sheet from a stack of media.

BACKGROUND OF THE INVENTION

In a printer, a copier, a scanner or other imaging system, paper or other media is loaded as a stack of cut sheets. A sheet is moved from the stack of media into the imaging region so that it can be printed, scanned, copied, or otherwise processed. A variety of rollers, for example, can be used to move the sheet from the stack into the imaging region. A roller that contacts a sheet in the stack of media is sometimes called the pick-up roller. The pick-up roller has a surface having sufficient friction with the sheet that when the pick-up roller is rotated, it causes the sheet to begin to move from the stack of media.

Power for rotating the pick-up roller can be supplied in a variety of ways, for example by a belt or by a gear train. The motor providing the power can be a dedicated motor for rotating the pick-up roller. In order to save the cost of additional motors, in some printing systems the motor powering the pick-up roller is shared with other functions in the imaging system, such as other portions of the media handling subsystem, or even for other more diverse functions of the imaging system, such as the maintenance station of an inkjet printer, as is described in U.S. Pat. Nos. 5,831,644; 5,971,520; 6,846,060; 7,225,697; and in commonly-assigned U.S. patent application Ser. Nos. 11/969,277 and 11/969,265.

There are different styles of pick-up assemblies. In some printers the pick-up roller(s) is/are mounted on a shaft that is fixed to the opposite sides of the printer. In other printers, a pick-up roller is mounted near one end of a pick arm that is pivotally mounted near the other end of the pick arm. A prior art example of a pivotable pick-up assembly 40, as described in commonly-assigned U.S. patent application Ser. No. 12/178,849 is shown in FIG. 1. Pick-up roller 320 is rotationally mounted on roller axle 46 near an end of pick arm frame 41. Near the other end of pick arm frame 41, drive gear 42 is mounted on axle, whose axis is coincident with the pivot axis of pick-up assembly 40. Drive gear 42 receives power from a motor (not shown), and transmits the power through axle 43 and gear train 45 to pick-up roller 320. Optionally, a torsion spring 44 provides a torque to cause the pivotable pick-up assembly 40 to rotate about its pivot axis so that the surface of the pick-up roller 320 is forced into contact with a sheet of a stack of media.

If power is supplied to a pivotable pick arm at the pivot mount end, and if the power is transmitted along the pick arm by a gear train to a pick-up roller at the other end, in some circumstances the gears of the gear train can bind, grind or lock up, causing noise or even damage to the gears. In particular, for printers or other imaging systems having a compact design, but capable of holding a relatively large stack of media, the length of the pick arm is not much larger than the maximum media stack height. In such cases, the range of angles of the pick arm with respect to the plane of the media stack, as the stack height goes from maximum to minimum, can include angles where forces on the pick arm inhibit free rotation of the gear train.

Furthermore, in a compact design printer or other imaging system, the space occupied by the gear train can compete with space needed for other components. Finally, in systems where the pick-up roller is driven by a motor having multiple functions, initiation of printing can be delayed if the motor is otherwise engaged and cannot therefore immediately move the next sheet of paper from the stack of media. This can slow down printing throughput.

What is needed is a power source and power transmission arrangement for driving a pivotable pick-up assembly consistent with compact imaging system design, reliable operation, low cost, and fast throughput.

SUMMARY OF THE INVENTION

The present invention addresses the aforementioned need by providing a novel pick-up assembly for moving a sheet of recording medium from a stack of recording media. The novel pick-up assembly includes a pick arm having a first end and a second end. Notably, a pivotal mounting is located proximate the first end of the pick arm; and a pick-up roller is mounted proximate the second end of the pick arm. Lastly, a motor and a transmission are located inside the pick-up roller of the novel pick-up assembly.

DETAILED DESCRIPTION OF THE INVENTION

Figure 2:
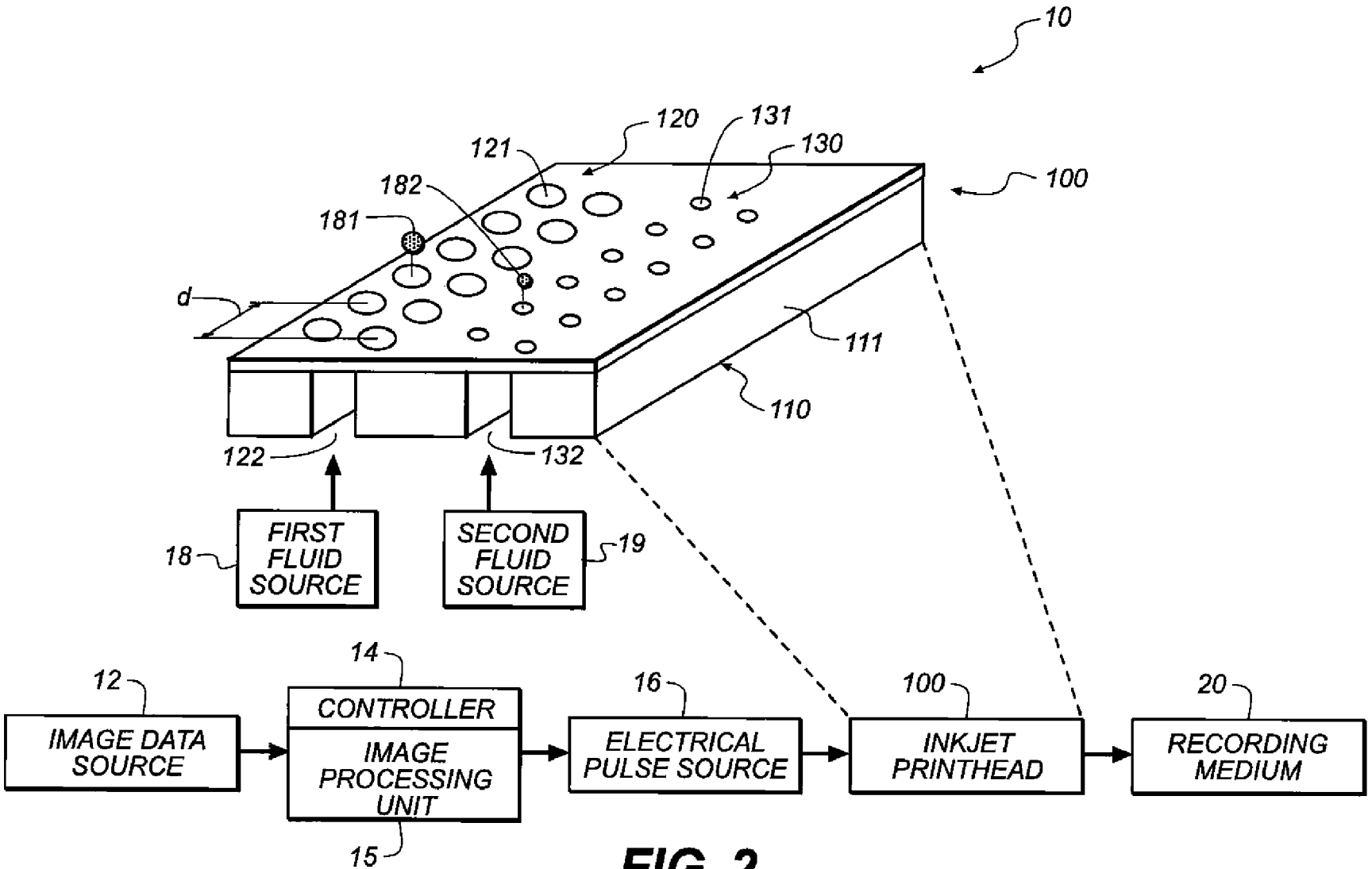
FIG. 2 is a schematic representation of an inkjet printer system.

Referring to FIG. 2, a schematic representation of an inkjet printer system 10 is shown, for its usefulness with the present invention (fully described in U.S. Pat. No. 7,350,902), and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 2, there are two nozzle arrays. Nozzles 121, in the first nozzle array 120, have a larger opening area than nozzles 131, in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 2). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of fluid delivery pathways 122 and 132 are shown in FIG. 2 as openings through printhead die substrate 111. One or more inkjet printhead die 110 will be included in inkjet printhead 100, but for greater clarity only one inkjet printhead die 110 is shown in FIG. 2. The printhead die are arranged on a support member as discussed below relative to FIG. 3. In FIG. 2, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications, it may be beneficial to have a single fluid source supplying ink to both the first nozzle array 120 and the second nozzle array 130 via ink delivery pathways 122 and 132, respectively. Also, in some embodiments, fewer than two or more than two nozzle arrays may be included on printhead die 110. In some embodiments, all nozzles on inkjet printhead die 110 may be the same size, rather than having multiple-sized nozzles on inkjet printhead die 110.

Not shown in FIG. 2, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example: by heating a bi-layer element) and thereby cause ejection. In any case, electrical pulses from electrical pulse source 16 are sent to the various drop ejectors according to the desired deposition pattern. In the example of FIG. 2, droplets 181 ejected from the first nozzle array 120 are larger than droplets 182 ejected from the second nozzle array 130, due to the larger nozzle opening area. Typically, other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 3:
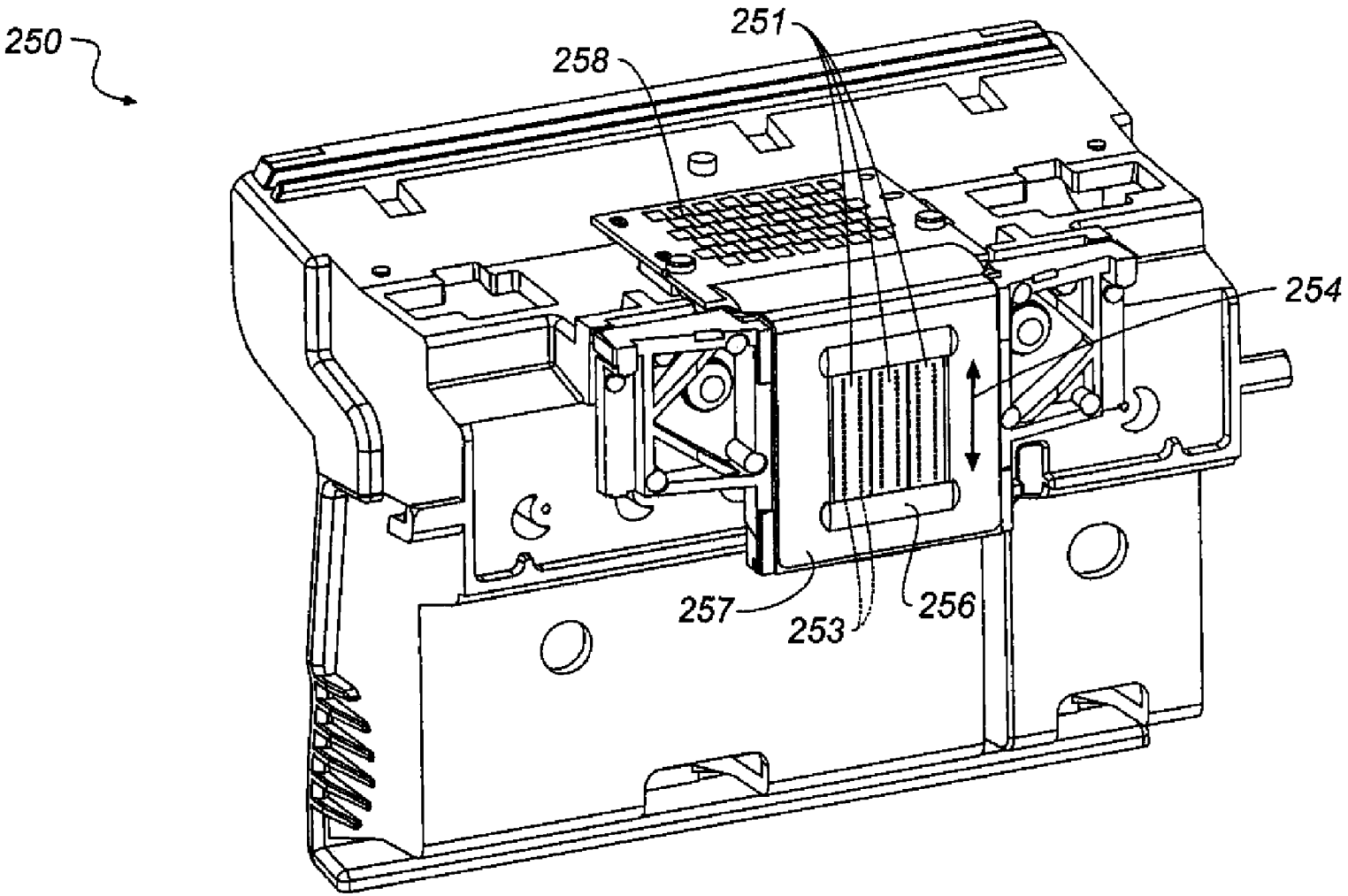
FIG. 3 is a perspective view of a portion of a printhead chassis.

FIG. 3 shows a perspective view of a portion of a printhead chassis 250, which is an example of an inkjet printhead 100. Printhead chassis 250 includes three printhead die 251 (similar to printhead die 110), each printhead die 251 containing two nozzle arrays 253, so that printhead chassis 250 contains six nozzle arrays 253 altogether. The six nozzle arrays 253 in this example may be each connected to separate ink sources (not shown in FIG. 3); such as cyan, magenta, yellow, text black, photo black, and a colorless protective printing fluid. Each of the six nozzle arrays 253 is disposed along nozzle array direction 254, and the length of each nozzle array along direction 254 is typically on the order of 1 inch or less. Typical lengths of recording media are 6 inches for photographic prints (4 inches by 6 inches) or 11 inches for paper (8.5 inches by 11 inches). Thus, in order to print the full image, a number of swaths are successively printed while moving printhead chassis 250 across the recording medium 20. Following the printing of a swath, the recording medium 20 is advanced along a media advance direction 304 that is substantially parallel to nozzle array direction 254.

Also shown in FIG. 3 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 4), connector board 258 is electrically connected to a connector (not shown) on the carriage 200, so that electrical signals may be transmitted to the printhead die 251.

Figure 4:
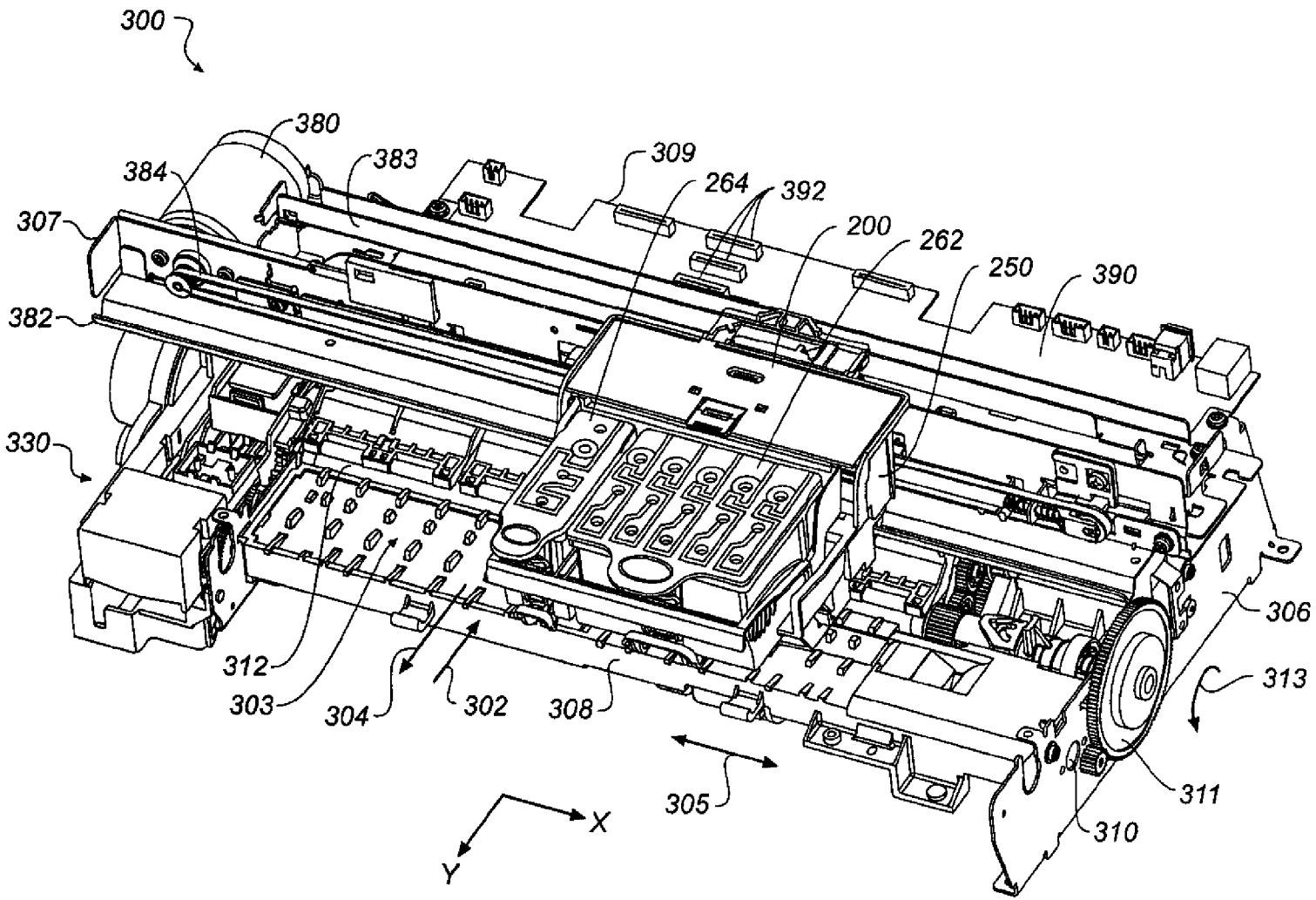
FIG. 4 is a perspective view of a portion of a carriage printer.

FIG. 4 shows a portion of a desktop carriage printer. Some of the parts of the printer have been hidden in the view shown in FIG. 4 so that other parts may be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 3, so that the printhead die 251 are located at the bottom side of printhead chassis 250, the droplets of ink being ejected downward onto the recording medium in print region 303 in the view of FIG. 4. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 5:
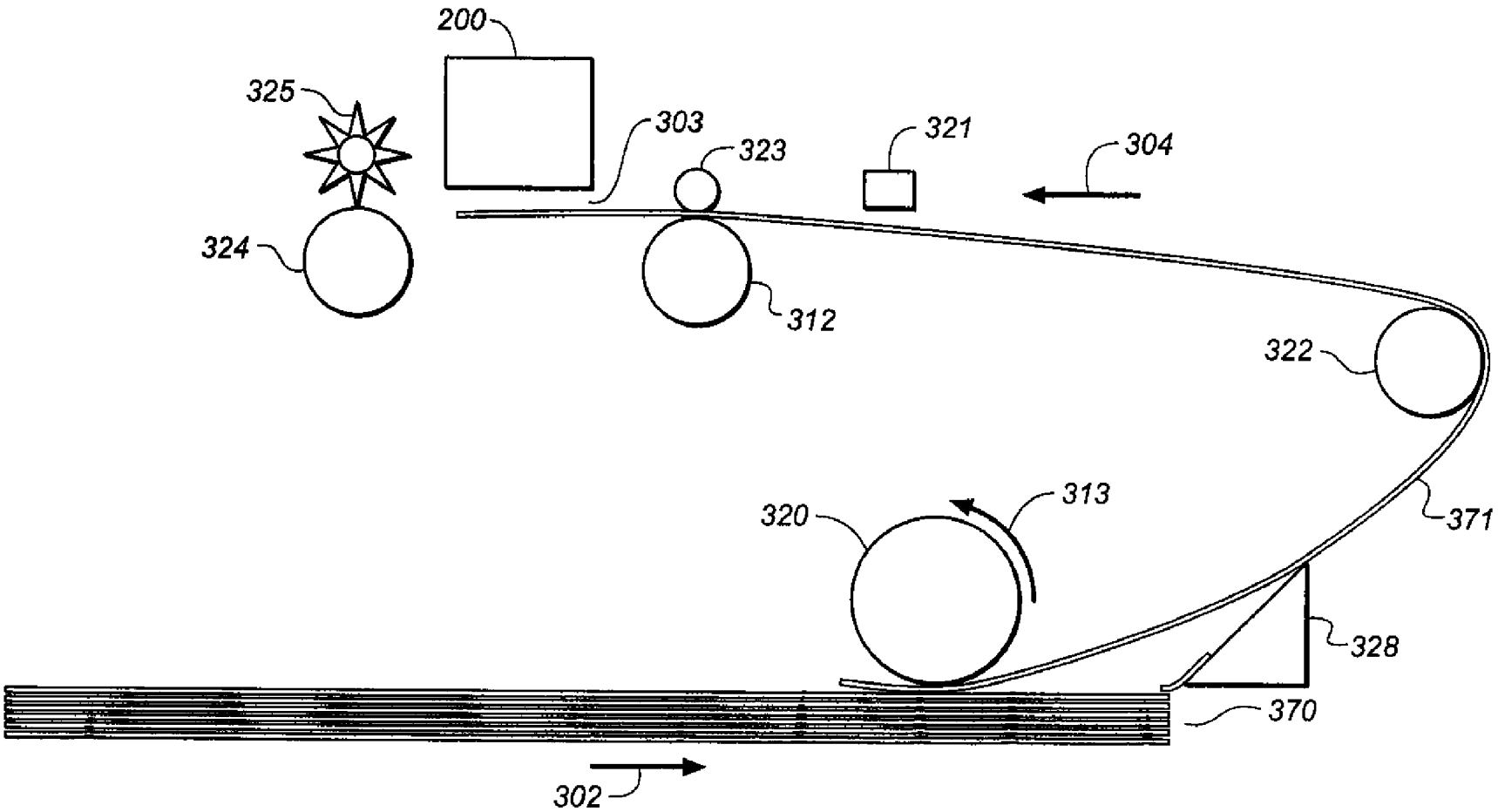
FIG. 5 is a schematic side view of an exemplary paper path in a carriage printer.

A variety of rollers are used to advance the medium through the printer as shown schematically in the side view of FIG. 5. In this example, a pick-up roller 320 moves the top piece or sheet 371 of a stack 370 of paper or other recording medium in the direction of arrow, paper load entry direction 302. A paper separator 328 allows top sheet of medium 371 to pass, but blocks additional sheets below the top sheet from advancing. A turn roller 322 acts to move the top piece of medium 371 around a C-shaped path (in cooperation with a curved rear wall surface) so that the paper continues to advance along media advance direction 304 from the rear 309 of the printer chassis (with reference also to FIG. 4). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers feed roller 312 is not shown in FIG. 4, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 4, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor(s), a processor and/or other control electronics (shown schematically as controller 14 and image processing unit 15 in FIG. 2) for controlling the printing process, and an optional connector for a cable to a host computer.

Figure 6:
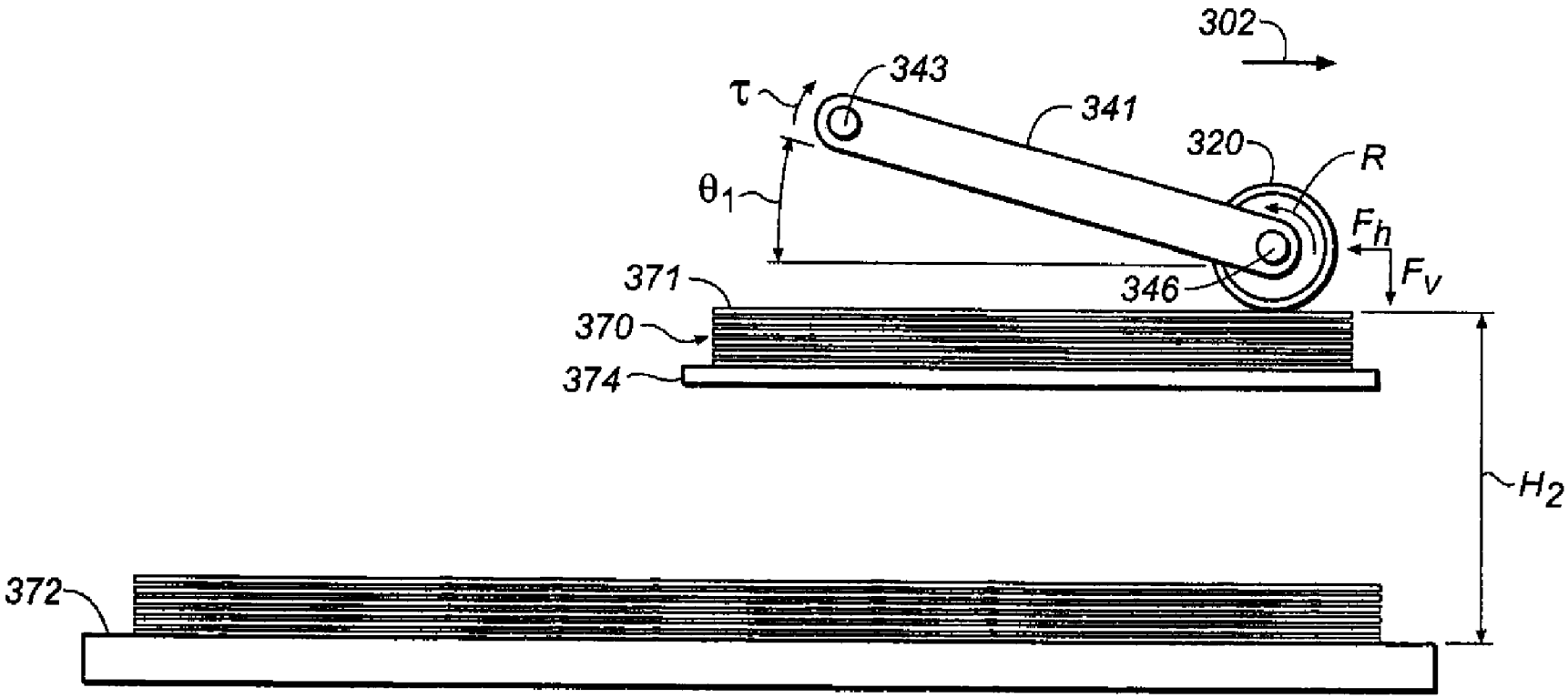
FIG. 6 is a schematic side view of a pick arm having a pick-up roller in contact with the top piece of medium on an upper tray.
Figure 7:
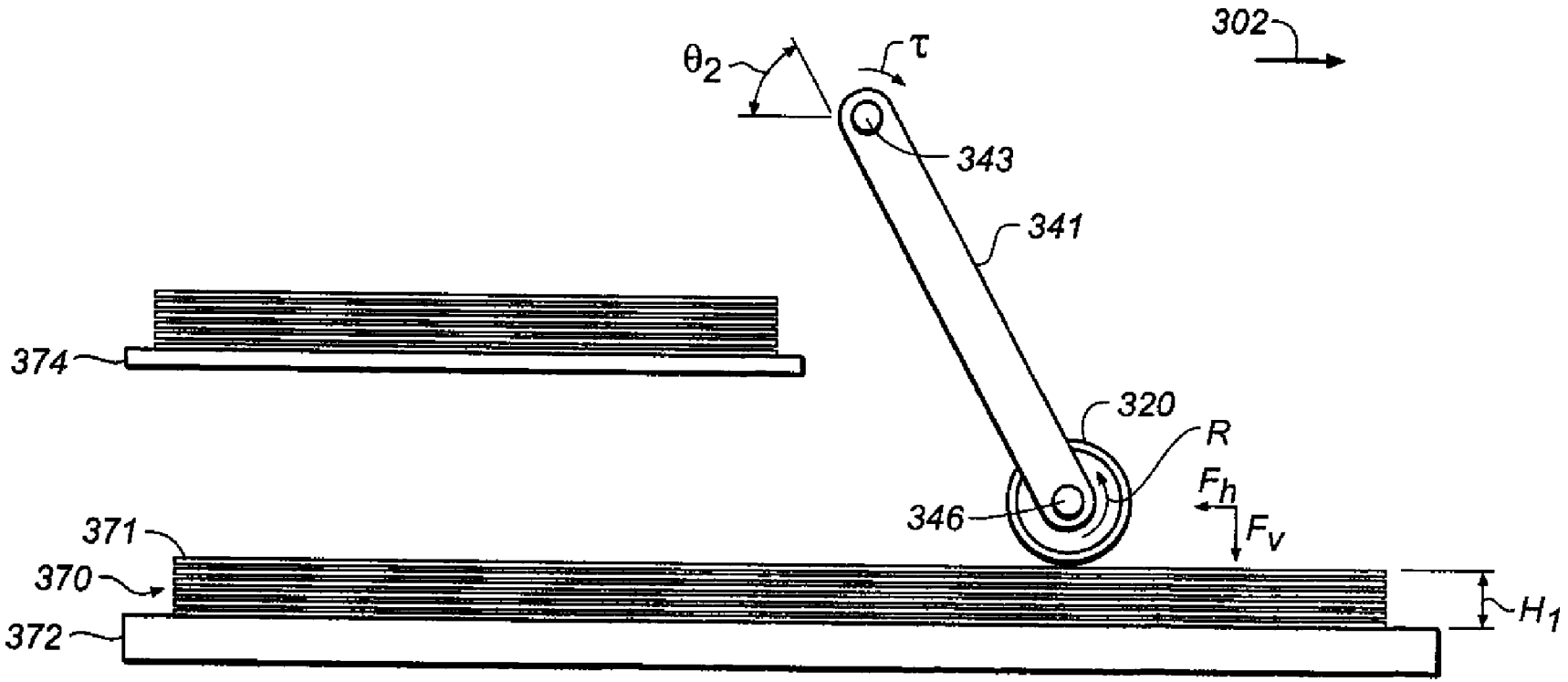
FIG. 7 is a schematic side view of a pick arm having a pick-up roller in contact with the top piece of medium on a lower tray.

Some types of printers include two media trays, one over the other, for storing media of two different sizes prior to printing. FIGS. 6 and 7 show schematic side views of a horizontal main media tray 372 and a horizontal photo media tray 374 in a region of the paper path corresponding to the lower portion of FIG. 5. The photo media tray 374 is movable horizontally relative to the main media tray 372. A pick-up roller 320 is mounted on roller axle 346 on pick arm 341, which is pivotable about a pivot axle 343. The pick-up roller 320 contacts the top piece of medium 371 of the media stack 370 on the photo media tray 374 when the photo media tray is in the print position, as it is in FIG. 6. When the photo media tray 374 is moved into the load position, as in FIG. 7, the pick arm 341 pivots downward so that the pick-up roller 320 contacts the top piece of medium 371 of the media stack 370 on the main media tray 372. In either case, when the pick-up roller 320 is rotated in direction R, the top piece of medium 371 in contact with the pick-up roller 320 is moved in paper load entry direction 302.

Figure 1:
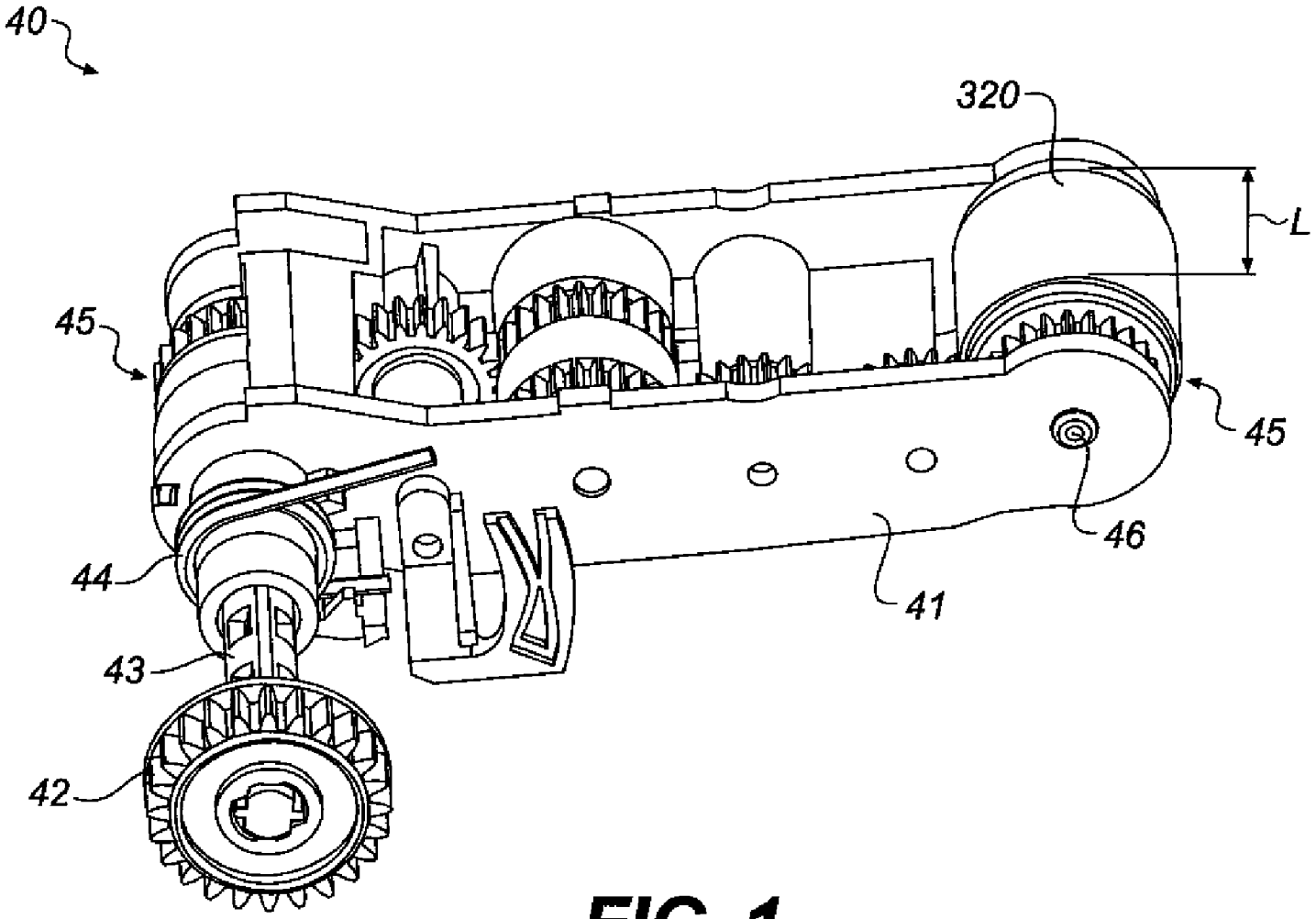
FIG. 1 (PRIOR ART)
FIG. 1 is a prior art pivotable pick-up assembly having a gear train to transmit power to rotate the pick-up roller.

If the pivotable pick arm 341 is part of a pick-up assembly including a gear train, such as prior art pivotable pick-up assembly 40 shown in FIG. 1, then a torque $\tau$ is applied at pivot axle 343 when it is desired to turn the pick-up roller 320. Torque $\tau$ turns the gears in the gear train, and power is transmitted to rotate pick-up roller 320. If there are an even number of gears in the gear train, between the pivot axle 343 and the pick-up roller 320 (as there are in the prior art example shown in FIG. 1), then the pick-up roller rotation direction R will be opposite the direction of torque $\tau$. In addition to providing power to rotate pick-up roller 320, torque $\tau$ also provides a force F that is perpendicular to pick arm 341 at roller axle 346. Force F may be resolved into two components, a horizontal force $F_h$=h sin $\theta$ and a vertical component $F_v$=F cos $\theta$, where F is the magnitude of the force F, and $\theta$ is the angle between the pick arm axis (i.e. a line drawn between the pivot axle 343 and the roller axle 346) and the horizontal plane of the media. In the examples shown in FIGS. 6 and 7, $F_h$ points to the left, while $F_v$ points downward.

In example of FIG. 6, where the pick-up roller 320 is in contact with the top piece of medium 371 on the photo media tray 374, the angle $\theta_1$ between the pick arm 343 and horizontal is relatively small, so the horizontal force $F_h$ is somewhat smaller than the vertical force $F_v$. In example of FIG. 7, where the pick-up roller 320 is in contact with the top piece of medium 371 on the main media tray 372, the angle $\theta_2$ between the pick arm 343 and horizontal force $F_h$ is significantly larger than the vertical force $F_v$. When the horizontal force becomes sufficiently large and pushes the pick-up roller axle 346 toward the left as in FIG. 7, the pick arm 341 can begin to become wedged between the media stack 370 on the main media tray 372 and the pivot axle 343. This can cause the gears of the gear train to experience greater friction and begin to bind. As the gears begin to bind, more of the power applied at pivot axis 343 is transferred to the pick arm 341, further increasing the horizontal force and wedging of the pick arm to a greater extent. As a result, the gears can grind or lock up, causing increased noise and even damage to the gears. For a printer having a single tray, the range of pivotal travel of the pick-up roller end of the pick arm 341 would be 10 mm for a media stack height of 10 mm. Even greater range of pivotal travel of the pick-up roller end of pick arm 341 would be typical for printers having one tray above the other, as shown in FIGS. 6 and 7. In some instances, if the angle $\theta$ between the pick arm 341 and the plane of the recording medium (i.e. between the pick arm 341 and a horizontal direction in the configuration illustrated in FIG. 7) is greater than 45 degrees, a gear train in the pick arm 341 can be susceptible to wedging and binding of the gears. In other instances, wedging and binding of the gears are not a problem unless $\theta$ exceeds 70 degrees. In any case, for a pick arm length that is not substantially greater than the required pivoting travel of the pick-up roller from a full tray to an empty tray or from a full upper tray to an empty lower tray, a pick arm with a gear train can present reliability issues.

A central aspect of the present invention is the provision of a motor 350 concentrically mounted inside the pick-up roller 320. A coupling 355 transfers power from motor 350 to the pick-up roller 320 to cause it to rotate. Because the torque from the motor is applied at the pick-up roller axle 346 rather than at the pivot axle 343 of pick arm 341, there is not a torque from the motor 350 causing a wedging force on pick-up roller axle 346, and there is no gear train susceptible to binding between the pivot axle 343 and the pick-up roller axle 346. Even if the angle between the pick arm 341 and the horizontal direction is greater than 45 degrees (or even greater than 70 degrees), the pick arm and pick-up roller continue to operate reliably.

Figure 8:
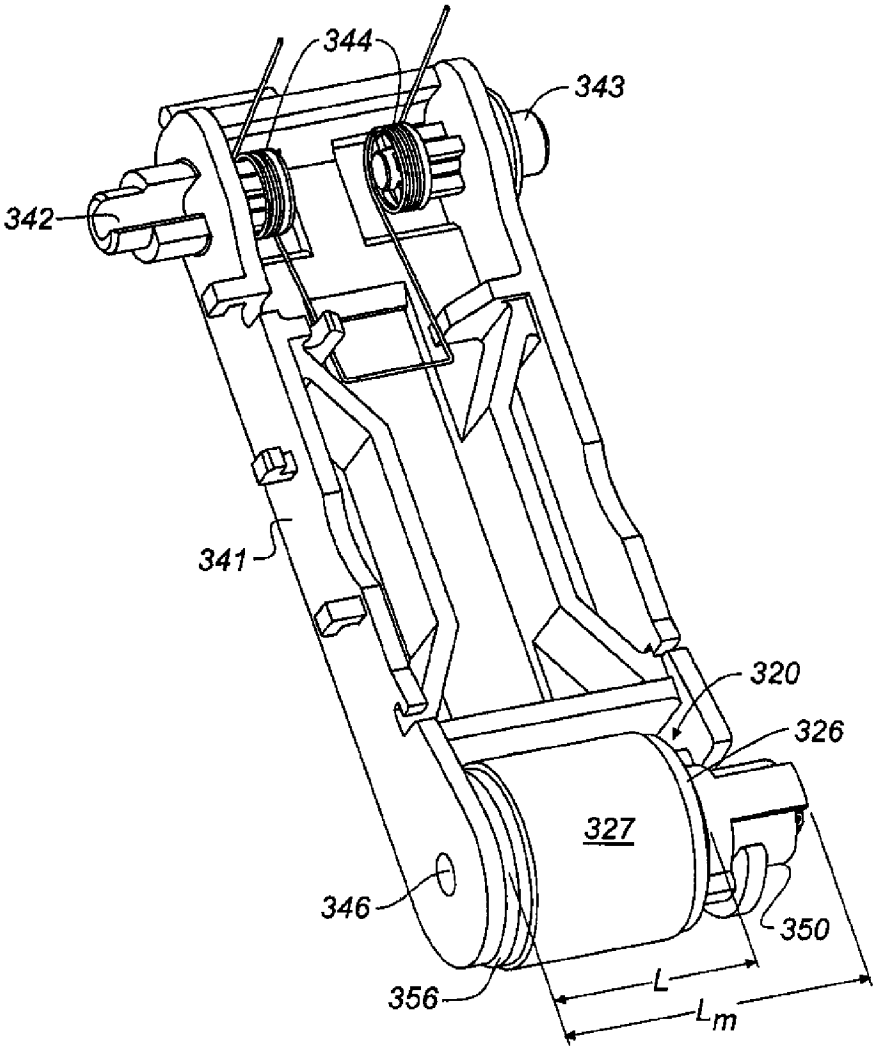
FIG. 8 is a perspective view of a motor located inside a pick-up roller, according to an embodiment of the invention.

FIG. 8 shows a perspective view of an embodiment of the invention. Pick-up roller 320 is rotationally mounted on roller axle 346 that is held near one end of pick arm 341. Pick-up motor 350 is concentrically located inside pick-up roller 320 so that pick-up motor axle 354 (FIG. 9) is colinear with roller axle 346. A low cost DC motor is suitable for use as pick-up motor 350. A DC pick-up motor 350 having a diameter of 10 mm and a length of 10 mm to 20 mm has been found to have adequate power to pick-up the media, move it past a paper separator 328 (FIG. 5) in order to move advance only the top piece of medium 371, and provide it to feed roller 312, which takes over the media advance at that point. Optionally, pick-up motor 350 can be longer than pick-up roller 320, as in the example shown in FIG. 8, so that a portion of the pick-up motor 350 extends beyond pick-up roller 320. The statement "Pick-up motor 350 is concentrically located inside pick-up roller 320" is not meant herein to imply that the entire pick-up motor 350 needs to be inside the pick-up roller 320. Pick arm 341 pivots about pivot axle 343. One end of pivot axle 343 optionally has an opening 342 so that electrical leads (not shown) from pick-up motor 350 can extend along the center of pivot axle 343. Optionally a torsion spring 344 is coaxially mounted on pivot axle 343 in order to provide a downward force on pick-up roller 320 against the stack of media. The torsion spring 344 shown in the example of FIG. 8 is configured as two sections that are symmetrically mounted on pivot axle 343. In order to distribute the load more uniformly, it can be advantageous to have more than 10 coils in torsion spring 344.

Figure 9:
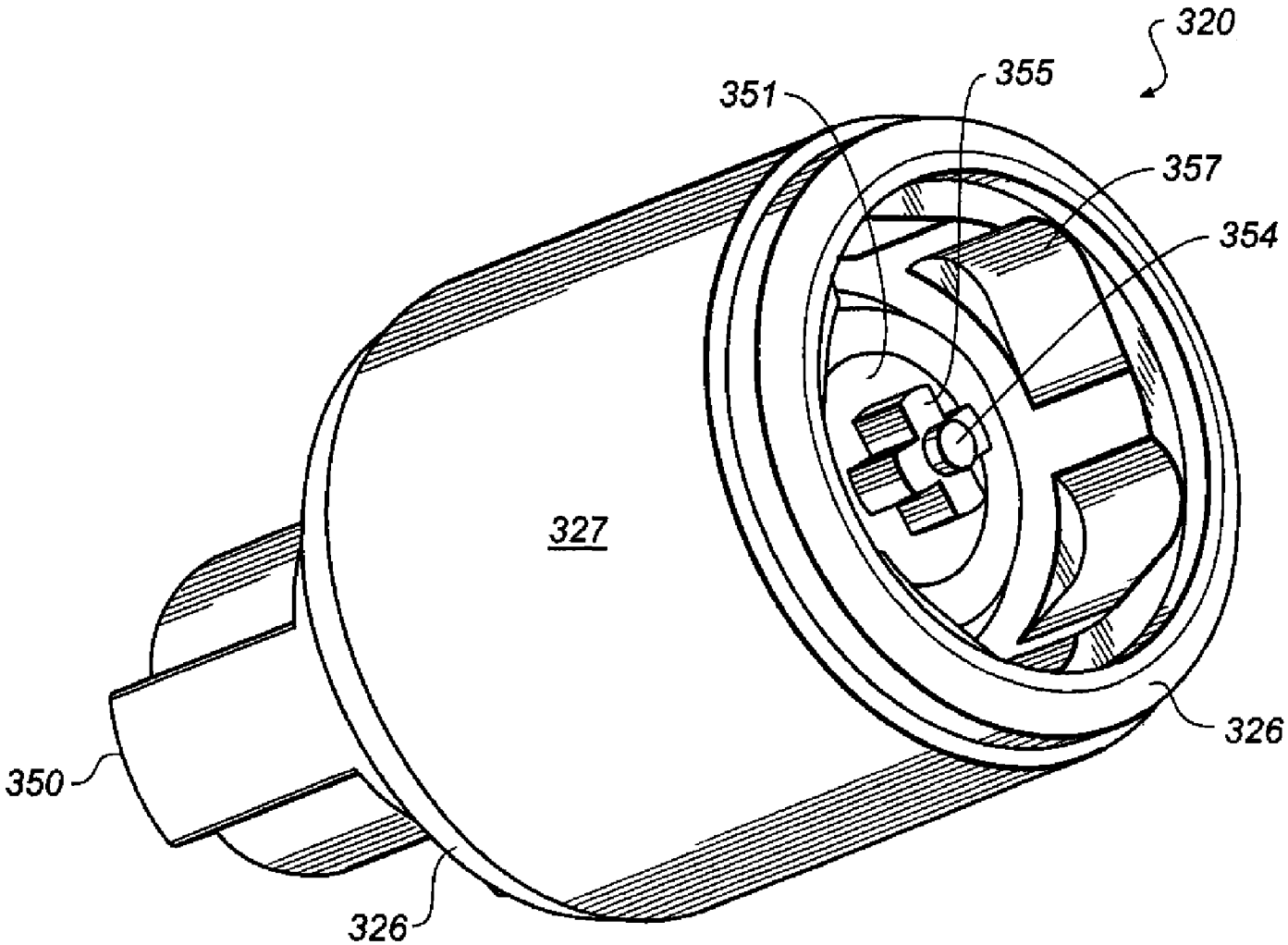
FIG. 9 is a perspective view of a motor located inside a pick-up roller, according to an embodiment of the invention.
Figure 10:
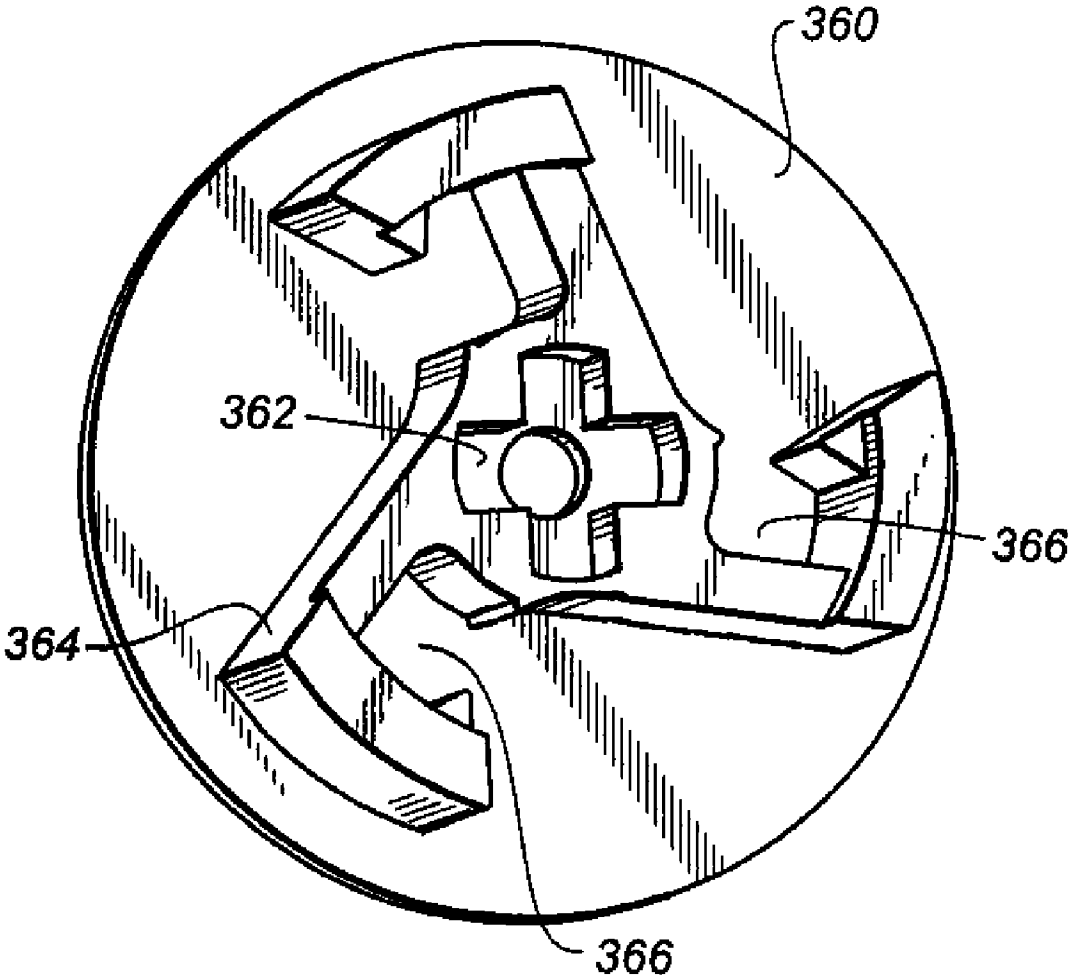
FIG. 10 is a perspective view of a face plate for a one way clutch, according to an embodiment of the invention.

FIG. 9 shows a pick-up motor 350 as viewed from the end indicated by label 346 in FIG. 8, but with the pick arm removed, and the clutch roller bearing face 360 (FIG. 10) removed from hub 326. Hub 326 has a friction surface 327, for example by mounting a band of rubber on hub 326. In the view shown in FIG. 9 with the clutch roller bearing face 360 removed, the coupling projection 355 that transfers rotational motion from pick-up motor 350 can be seen. In the embodiment shown in FIG. 9, coupling projection 355 is across-shaped projection (extending from the pick-up motor axle 354 at the outermost face of coupling and transmission plate 351) that fits into a corresponding cross-shaped coupling recess 362 in clutch roller bearing face 360 (FIG. 10). On the opposite side of coupling and transmission plate 351 is a planetary transmission that will be described below with reference to FIG. 12. Also seen in FIG. 9 are clutch bearing traps 357 inside hub 326. Clutch arms 362 on clutch roller bearing face 360 each hold a roller bearing (not shown) within a nesting position 366. Clutch arms 362, clutch bearing face 360, roller bearings (not shown) and clutch bearing traps 357 thus form a one-way clutch 356. The one-way clutch 356 allows free rotation of hub 326 in one direction, but couples hub movement to rotation of the pick-up motor 350 in the other rotation direction.

Figure 11B:
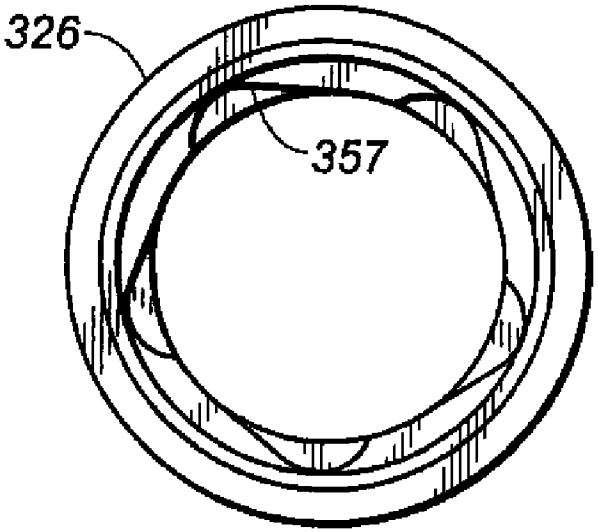
FIGS. 11A and 11B respectively are a perspective view and an end view of a hub of a pick-up roller into which a motor is inserted, according to an embodiment of the invention.
Figure 11A:
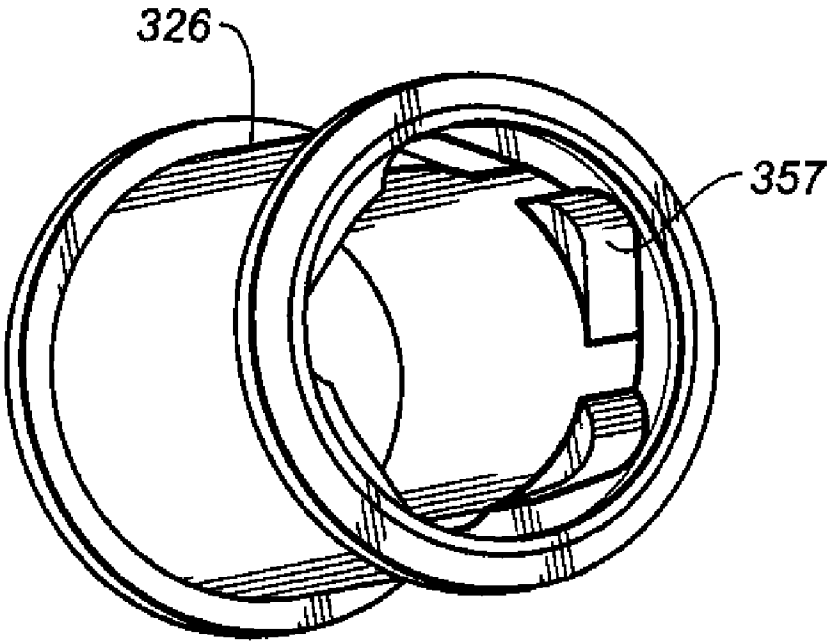

FIG. 11A shows a perspective view of hub 326 without the high friction surface 327 or the pick-up motor 350 installed. FIG. 11B shows an end view of hub 326. Clutch bearing traps 357 are shown in both FIGS. 11A and 11B.

Figure 12:
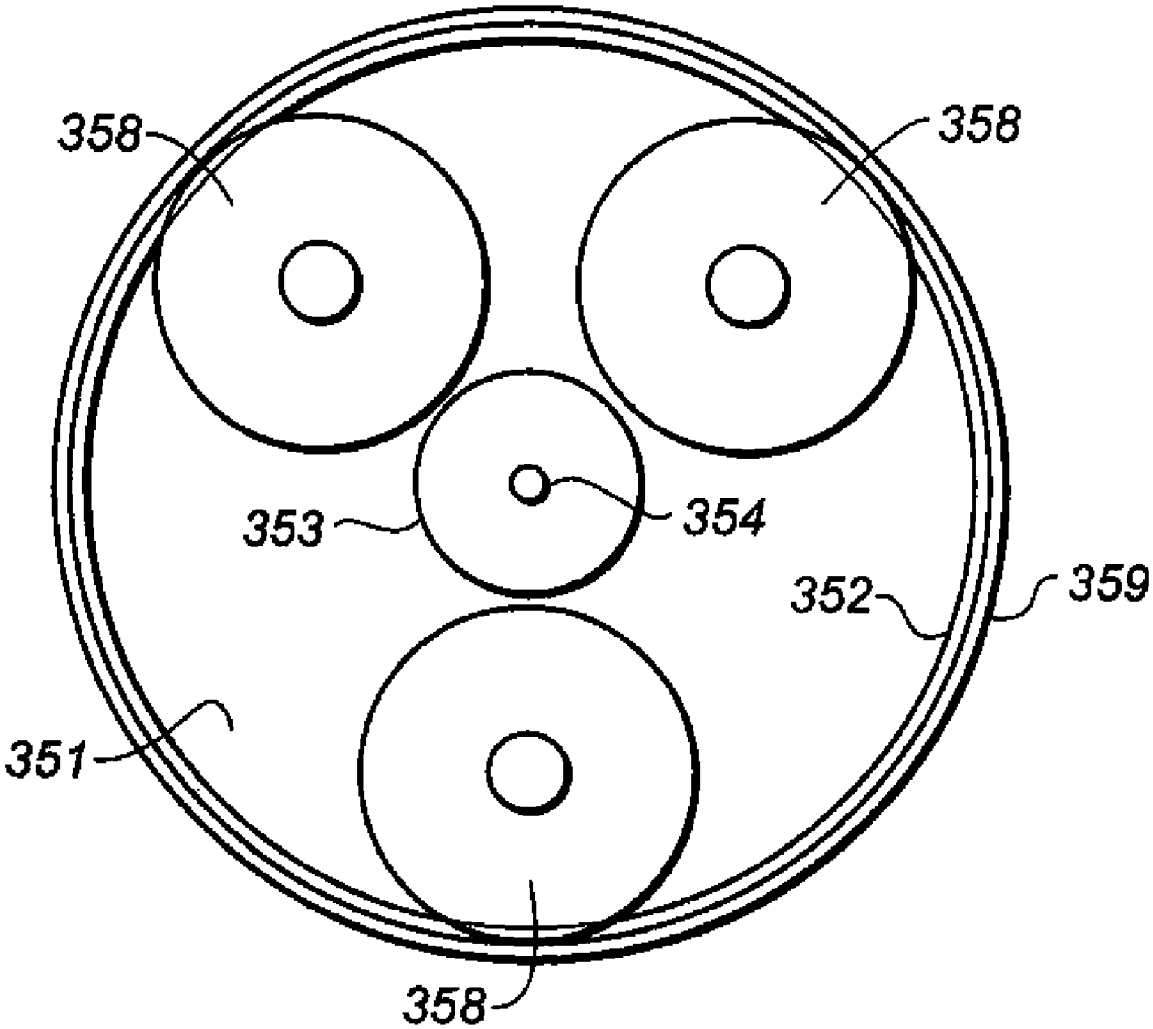
FIG. 12 is a schematic end view of planetary transmission for the motor inside the pick-up roller, according to an embodiment of the invention.
Figure 13:
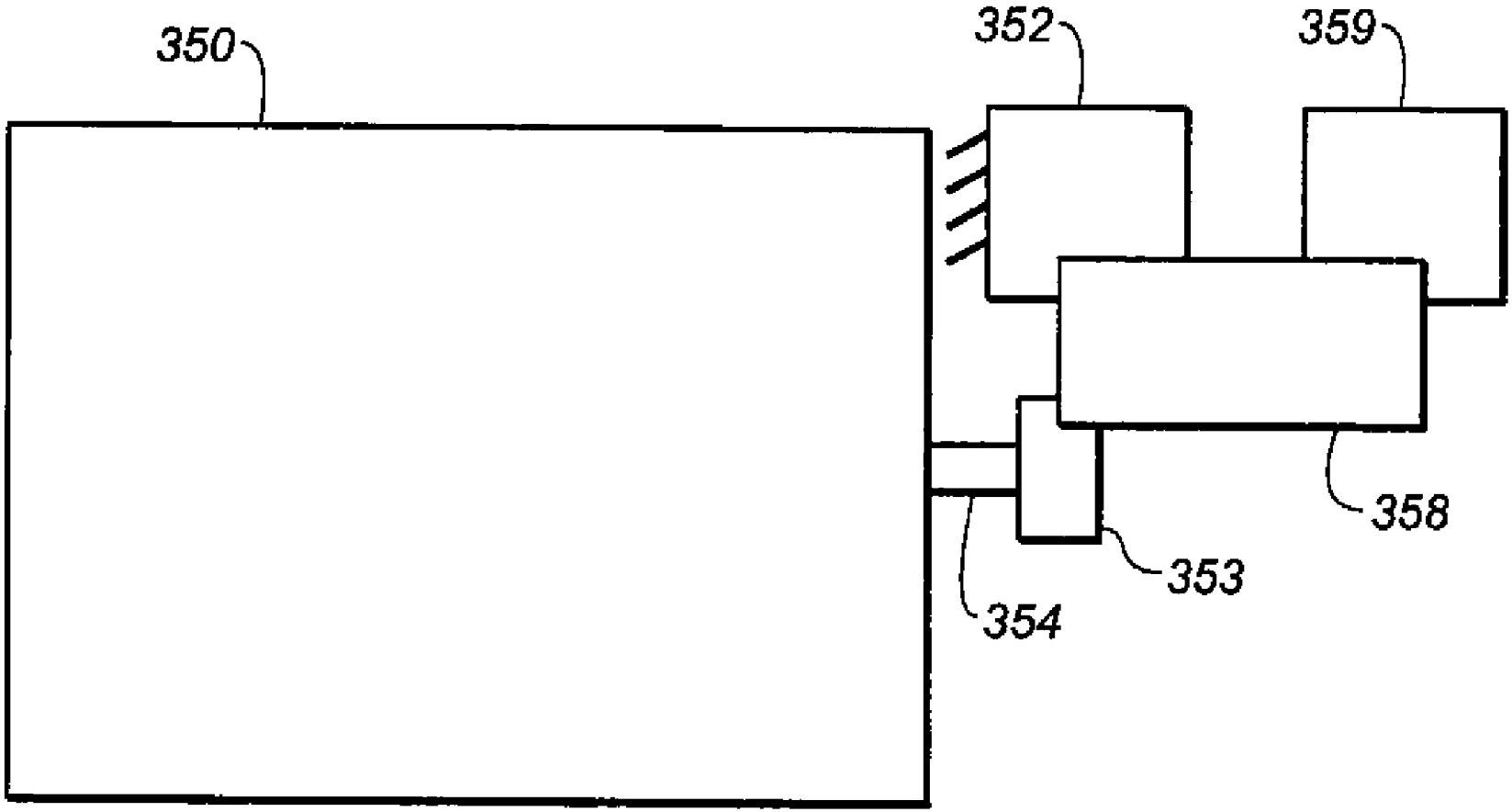
FIG. 13 is a schematic side view of the planetary transmission of FIG. 12.

FIG. 12 shows a schematic end and FIG. 13 shows a schematic side view of the planetary transmission that accomplishes gear reduction to increase the available torque from the pick-up motor 350. For simplicity, the gear teeth are not shown in FIGS. 12 and 13. In the embodiment shown, a two-stage planetary transmission is used to provide a high gear ratio between the motor pinion 353 to the output gear to drive pick-up roller 320, i.e. rotating ring gear 359. Inexpensive motors that fit inside the pick-up roller 320 typically provide rotation at high speed but low torque. In order to move the top sheet of medium 371, overcoming the friction with the adjacent sheet, and passing the paper separator 328, pick-up roller 320 must be driven with sufficient torque, but not at high speed. A two-stage planetary transmission is well suited to such an application, but other types of gearing (including a single-stage planetary transmission) can alternatively be used in some embodiments.

With reference to FIGS. 12 and 13, on the innermost side of coupling and transmission plate 351 are three planetary gears 358 that mesh at one end with motor pinion 353 (on pick-up motor axle 354). Motor pinion 353 functions as a sun gear. In the two-stage planetary transmission embodiment, the planetary gears 358 also mesh with a fixed ring gear 352 and a rotating ring gear 359. Fixed ring gear 352 is fixed to the motor 350. The planetary transmission, the one-way clutch 356, and the coupling projection 355 are all located within hub 326.

For a two-stage planetary transmission having a motor pinion 353 with a number A gear teeth, an output ring gear (rotating ring gear 359) having a number B gear teeth, and a fixed ring gear 352 with a number C gear teeth, the output gear ratio is equal to $(1+C/A)/(1-C/B)$. As long as the planetary gears 358 have the same number of teeth meshing with both the fixed ring gear 352 and the rotating ring gear 359, the output gear ratio is independent of the number of gear teeth on the planetary gears. It can be seen that a two-stage planetary transmission will have a high output gear ration if the number of teeth C on the fixed ring gear 352 is approximately equal to the number of teeth B on the rotating ring gear 359. In a particular example, the number of gear teeth on the motor pinion 353 was A=6, the number of gear teeth on the rotating ring gear 359 was B=54, and the number of gear teeth on the fixed ring gear 352 was 51, so that the output gear ratio was 171 to 1. In other embodiments requiring an output gear ratio on the order of 10 to 1, a single stage planetary transmission is sufficient.

Depending on the length L of the pick-up roller 320 (see FIG. 8) and the length $L_m$ of the motor 350, the motor might not fit entirely within hub 326 in a lengthwise fashion. For example, if the motor 350 has a length $L_m$=20 mm, but the pick-up roller 320 only has a length L=16 mm, the motor will extend partly beyond the motor insertion end of pick-up roller 320. For a pivotally mounted pick arm, the diameter of the pick-up roller is typically less than 40 mm, but there are many suitable motor designs having diameters less than 40 mm and enough power for media pick-up and transport to the feed roller 312.

Figure 14:
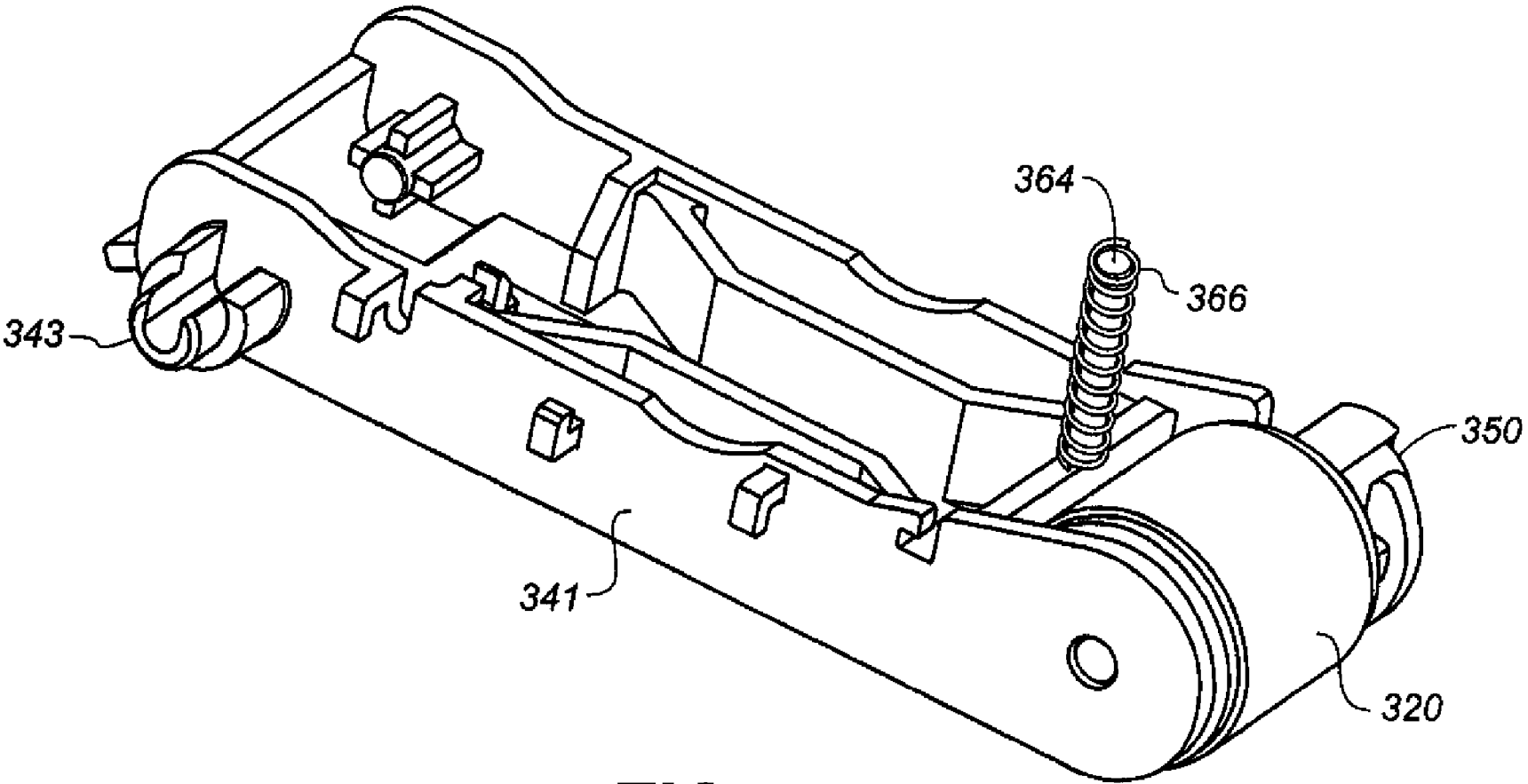
FIG. 14 is a perspective view of a motor located inside a pick-up roller, according to an embodiment of the invention.

In the embodiment shown in FIG. 8 a torsion spring 344 provides a downward force from the pick-up roller 320 to the top piece of medium 371 to generate sufficient friction for moving the top piece of medium 371 when the pick-up roller 320 turns. FIG. 14 shows an alternative embodiment in which a compression spring 366 is mounted on a post 364 on the pick-up arm 341 near the end at which the pick-up roller 320 is mounted. Compression spring 366 is pressed by a pressing member (not shown) to provide a downward force on pick-up roller 320. Alternatively one can configure a tension spring (not shown) to pull the pick-up arm 341 and pick-up roller 320 down into contact with the top piece of medium 371.

In some embodiments, the weight of the motor 350, the pick-up roller 320, and an optional additional mass (not shown) can be enough to provide the necessary frictional force between the friction surface 327 of pick-up roller 320 and the top piece of medium 371. Typically, a mass of at least 100 grams would be used to provide the downward force on the pick-up roller 320. For example, if a mass of 150 grams located near the end of the pick arm 341 where the pick-up roller 320 is mounted is enough to provide sufficient friction force, and if the mass of the motor 350 plus the pick-up roller 320 is 70 grams, then an additional mass (not shown) of 80 grams can be attached near that end of the pick arm 341.

Operation of media advance, according to an embodiment of this invention is as follows. With reference to FIG. 2, image data is sent from image data source 12 to controller 14 (FIG. 2). At the appropriate time relative to the processing of image data by image processing unit 15, controller 14 sends a signal to a pick-up roller motor controller on electronics board 390 (FIG. 4), and power is provided to turn motor 350 inside pick-up roller 320 (FIG. 8). The top piece of medium 371 is thereby advanced past paper separator 328 (FIG. 5). Motor 350 can be run open loop (i.e. not having its position referenced to an encoder). Instead, power is provided to motor 350 to turn pick-up roller 320 until an optical sensor 321 (FIG. 5) near feed roller 312 senses the lead edge of the top piece of medium 371. This signal is sent to controller 14, which sends a signal to the pick-up roller motor controller to turn off motor 350 after a delay of a few milliseconds, in order to allow the lead edge of the top piece of medium 371 to be captured by feed roller 312 and idler roller(s) 323. The one-way clutch 356 allows pick-up roller 350 to rotate freely and not cause additional drag on the top piece of the medium 371.

For printers that use a single motor to perform media advance (e.g. powering the feed roller 312) as well as other functions such as maintenance, by providing a dedicated motor 350 for the pick-up roller 320, initial maintenance functions can be carried out before a print without delaying the moving of the top piece of medium 371. This enables faster print out time for the first piece of media to be printed.

By eliminating the gear train from the pivotable pick-up assembly, additional room is available for other parts in a compact printer design. In addition, the elimination of the gear train and its assembly can pay for the cost of a low cost DC motor 350 in some embodiments.

Thus, the invention provides a power source and power transmission arrangement for driving a pivotable pick-up assembly consistent with compact imaging system design, reliable operation, low cost, and fast throughput.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
40 Pivotable pick-up assembly
41 Pick arm frame
42 Drive gear
43 Axle
44 Torsion spring
45 Gear train
46 Roller axle
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
250 Printhead chassis
251 Printhead die
253 Nozzle array
254 Nozzle array direction
256 Encapsulant
257 Flex circuit
258 Connector board
262 Multi-chamber ink supply
264 Single-chamber ink supply
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
321 Optical sensor
322 Turn roller
323 Idler roller
324 Discharge roller
325 Star wheel(s)
326 Pick-up roller hub
327 Friction surface
328 Paper separator
330 Maintenance station
341 Pick arm
343 Pivot axle
344 Torsion spring
346 Roller axle
347 Pivotal mounting
350 Pick-up motor
351 Coupling and transmission plate
352 Fixed ring gear
353 Motor pinion
354 Pick-up motor axle
355 Coupling projection
356 One-way clutch
357 Clutch bearing trap
358 Planetary gear
359 Rotating ring gear
360 Clutch roller bearing face
362 Coupling recess
364 Post
366 Compression spring
370 Stack of media
371 Top piece of medium
372 Main media tray
374 Photo media tray
380 Carriage motor
382 Carriage guide rail
383 Encoder fence
384 Belt
390 Printer electronics board
392 Cable connectors

What is claimed is:

1. A pick-up assembly for moving a sheet of recording medium from a stack of recording media, the pick-up assembly comprising:

a pick arm including a first end and a second end;

a pivotal mounting located proximate the first end of the pick arm;

a pick-up roller mounted proximate the second end of the pick arm;

a motor and a transmission located inside the pick-up roller, wherein the transmission has an output gear ratio that is greater than 10 to 1; and a one-way clutch inside the pick-up roller, the one-way clutch including a roller bearing face having a recess, wherein the motor is coupled to the pick-up roller by at least one projection extending from an axle of the motor and fitting into the recess in the roller bearing face.

2. The pick-up assembly claimed in claim 1, wherein the motor is a DC motor.

3. The pick-up assembly claimed in claim 1, wherein the one-way clutch is located within the pick-up roller while a portion of the motor extends partly from the pick-up roller.

4. The pick-up assembly claimed in claim 1 further comprising a torsion spring is located proximate the first end of the pick arm.

5. The pick-up assembly claimed in claim 4, wherein the torsion spring is coaxially mounted with the pivotal mounting of the pick arm.

6. The pick-up assembly claimed in claim 4, wherein the torsion spring includes at least 10 coils.

7. The pick-up assembly claimed in claim 1, wherein the diameter of the pick-up roller is less than 40 mm.

8. The pick-up assembly claimed in claim 1 further comprising a compression spring located proximate the second end of the pick arm.

9. The pick-up assembly claimed in claim 1 further comprising a mass of greater than 100 grams located at the second end of the pick arm.

10. The pick-up assembly claimed in claim 1, wherein the transmission is for coupling the motor to the pick-up roller and is a planetary transmission.

11. The pick-up assembly claimed in claim 10, wherein the planetary transmission has more than one stage.

12. The pick-up assembly claimed in claim 1, wherein the second end of the pick arm pivotally travels a distance of at least 10 mm.

13. The pick-up assembly claimed in claim 1, wherein the stack of recording medium is located in an input tray and when the pick-up roller contacts the input tray, the angle between the pick arm and a horizontal direction is greater than 45 degrees.

14. The pick-up assembly claimed in claim 1, wherein the stack of recording medium is located in an input tray and when the pick-up roller contacts the input tray, the angle between the pick arm and a horizontal direction is greater than 70 degrees.

15. The pick-up assembly claimed in claim 1, wherein position of the motor is not referenced to an encoder.

16. The pick-up assembly claimed in claim 1 further comprising a tension spring located proximate the second end of the pick arm.

17. A pick-up assembly for moving a sheet of recording medium from a stack of recording media, the pick-up assembly comprising:

a pick arm including a first end and a second end;

a pivotal mounting located proximate the first end of the pick arm;

a pick-up roller mounted proximate the second end of the pick arm; and a motor and a transmission located inside the pick-up roller, wherein the transmission is for coupling the motor to the pick-up roller and is a planetary transmission, wherein the planetary transmission has an output gear ratio that is greater than 10 to 1, and wherein the planetary transmission has more than one stage.

18. The pick-up assembly claimed in claim 17, wherein the motor is a DC motor.

19. The pick-up assembly claimed in claim 17, wherein the motor is coupled to the pick-up roller by at least one projection extending from an axle of the motor.

20. The pick-up assembly claimed in claim 17 further comprising a torsion spring is located proximate the first end of the pick arm.

21. The pick-up assembly claimed in claim 20, wherein the torsion spring is coaxially mounted with the pivotal mounting of the pick arm.

22. The pick-up assembly claimed in claim 20, wherein the torsion spring includes at least 10 coils.

23. The pick-up assembly claimed in claim 17, wherein the diameter of the pick-up roller is less than 40 mm.

24. The pick-up assembly claimed in claim 17 further comprising a compression spring located proximate the second end of the pick arm.

25. The pick-up assembly claimed in claim 17 further comprising a mass of greater than 100 grams located at the second end of the pick arm.

26. The pick-up assembly claimed in claim 17, wherein the second end of the pick arm pivotally travels a distance of at least 10 mm.

27. The pick-up assembly claimed in claim 17, wherein the stack of recording medium is located in an input tray and when the pick-up roller contacts the input tray, the angle between the pick arm and a horizontal direction is greater than 45 degrees.

28. The pick-up assembly claimed in claim 17, wherein the stack of recording medium is located in an input tray and when the pick-up roller contacts the input tray, the angle between the pick arm and a horizontal direction is greater than 70 degrees.

29. The pick-up assembly claimed in claim 17, wherein position of the motor is not referenced to an encoder.

30. The pick-up assembly claimed in claim 17 further comprising a tension spring located proximate the second end of the pick arm.

31. A pick-up assembly for moving a sheet of recording medium from a stack of recording media, the pick-up assembly comprising:

a pick arm including a first end and a second end;

a pivotal mounting located proximate the first end of the pick arm;

a pick-up roller mounted proximate the second end of the pick arm; and a motor and a transmission located inside the pick-up roller, wherein the transmission has an output gear ratio that is greater than 10 to 1.

32. The pick-up assembly claimed in claim 31, wherein the motor is a DC motor.

33. The pick-up assembly claimed in claim 31, wherein the motor is coupled to the pick-up roller by at least one projection extending from an axle of the motor.

34. The pick-up assembly claimed in claim 31 further comprising a torsion spring is located proximate the first end of the pick arm.

35. The pick-up assembly claimed in claim 34, wherein the torsion spring is coaxially mounted with the pivotal mounting of the pick arm.

36. The pick-up assembly claimed in claim 34, wherein the torsion spring includes at least 10 coils.

37. The pick-up assembly claimed in claim 31, wherein the diameter of the pick-up roller is less than 40 mm.

38. The pick-up assembly claimed in claim 31 further comprising a compression spring located proximate the second end of the pick arm.

39. The pick-up assembly claimed in claim 31 further comprising a mass of greater than 100 grams located at the second end of the pick arm.

40. The pick-up assembly claimed in claim 31, wherein the second end of the pick arm pivotally travels a distance of at least 10 mm.

41. The pick-up assembly claimed in claim 31, wherein the stack of recording medium is located in an input tray and when the pick-up roller contacts the input tray, the angle between the pick arm and a horizontal direction is greater than 45 degrees.

42. The pick-up assembly claimed in claim 31, wherein the stack of recording medium is located in an input tray and when the pick-up roller contacts the input tray, the angle between the pick arm and a horizontal direction is greater than 70 degrees.

43. The pick-up assembly claimed in claim 31, wherein position of the motor is not referenced to an encoder.

44. The pick-up assembly claimed in claim 31 further comprising a tension spring located proximate the second end of the pick arm.

45. The pick-up assembly claimed in claim 31 wherein the transmission is for coupling the motor to the pick-up roller and is a planetary transmission.

* * * * *